US007019699B2

(12) United States Patent
Komatsu et al.

(10) Patent No.: US 7,019,699 B2
(45) Date of Patent: Mar. 28, 2006

(54) ON-BOARD ANTENNA

(75) Inventors: Satoru Komatsu, Saitama (JP); Hiroshi Kuribayashi, Saitama (JP); Tomoyuki Fukumaru, Saitama (JP); Hiroshi Iijima, Osaka (JP); Hideaki Oshima, Osaka (JP); Tatsuo Matsushita, Ibaraki (JP)

(73) Assignees: Honda Motor Co., Ltd., Tokyo (JP); Nippon Sheet Glass Company, Ltd., Osaka (JP)

( * ) Notice: Subject to any disclaimer, the term of this patent is extended or adjusted under 35 U.S.C. 154(b) by 41 days.

(21) Appl. No.: 10/743,942

(22) Filed: Dec. 24, 2003

(65) Prior Publication Data

US 2004/0135728 A1 Jul. 15, 2004

(30) Foreign Application Priority Data

Dec. 27, 2002 (JP) ..... P2002-379995

(51) Int. Cl.
*H01Q 1/32* (2006.01)

(52) U.S. Cl. ..... 343/711; 343/712; 343/713; 343/767; 343/769; 343/789; 343/700 MS

(58) Field of Classification Search ..... 343/711–713, 343/767, 769, 789, 700 MS
See application file for complete search history.

(56) References Cited

U.S. PATENT DOCUMENTS 4,682,180 A * 7/1987 Gans ..... 343/769
5,568,159 A * 10/1996 Pelton et al. ..... 343/767
5,621,419 A * 4/1997 Meek et al. ..... 343/770
5,629,712 A * 5/1997 Adrian et al. ..... 343/713
5,714,961 A * 2/1998 Kot et al. ..... 343/769
5,905,471 A * 5/1999 Biebl et al. ..... 343/769
6,097,345 A * 8/2000 Walton ..... 343/769
6,188,368 B1 * 2/2001 Koriyama et al. ..... 343/767
6,246,377 B1 * 6/2001 Aiello et al. ..... 343/770
6,329,950 B1 * 12/2001 Harrell et al. ..... 343/700 MS
6,448,935 B1 * 9/2002 Fuchs et al. ..... 343/713
2001/0050651 A1 * 12/2001 Grangeat et al. ..... 343/767
2004/0164916 A1 * 8/2004 Jecko et al. ..... 343/767

FOREIGN PATENT DOCUMENTS

JP 2002-252520 9/2002
WO WO 96/10276 4/1996

OTHER PUBLICATIONS

Wen-Shyang Chen et al., "Single-Feed Circularly Polarized Square-Ring Microstrip Antennas With A Slit", Jun. 21, 1998 pp. 1360-1363.*
Wen-Shyang Chen, et al., "Single-Feed Circularly Polarized Square-Ring Microstrip Antennas with a Slit", Jun 21, 1998, pp. 1360-1363.

* cited by examiner

*Primary Examiner*—Tuyet Vo
*Assistant Examiner*—Leith Al-Nazar
(74) *Attorney, Agent, or Firm*—Arent Fox PLLC

(57) ABSTRACT

An on-board antenna including a radiation element provided on a dielectric substrate, and a grounding conductor surrounding a periphery of an outer edge portion of the radiation element at a position spaced away outwardly from the outer edge portion, wherein the radiation element has an inner cut-out portion so that the surface of the dielectric substrate to be exposed therethrough.

11 Claims, 3 Drawing Sheets

ON-BOARD ANTENNA

BACKGROUND OF THE INVENTION

1. Field of the Invention

The present invention relates to an on-board antenna.

2. Description of the Related Art

Conventionally, a planar antenna is known which comprises a radiation element provided on the same surface of, for example, an automotive window glass which is located on a passenger compartment side thereof and a substantially annular grounding conductor which surrounds the periphery of an outer edge portion of the radiation element at a position spaced away outwardly from the outer edge portion of the radiation element (for example, refer to Japanese Published Patent Application JP-A-2002-252520.

Incidentally, in installing the planer antenna according to the aforesaid conventional example on a vehicle, in the event that the planner antenna is installed on an automotive window glass such as a front windshield or rear window glass, for example, it is desired to prevent the antenna not only from interrupting the vision of occupants of the vehicle but also from deteriorating the external appearance of the vehicle.

In association with this, it has been desired to make the planar antenna smaller in size while securing desired transmitting and receiving properties for the planar antenna.

SUMMARY OF THE INVENTION

The present invention was made in view of the situations, and an object thereof is to provide an on-board antenna which can be made smaller in size while securing desired transmitting and receiving properties therefor.

With a view to solving the problem so as to attain the object, according to a first aspect of the present invention, there is provided an on-board antenna comprising a radiation element provided on the same surface (for example, a passenger compartment-side inner surface 2A in the embodiment) of a dielectric substrate (for example, a rear window glass 2 in the embodiment) and a grounding conductor which surrounds a periphery of an outer edge portion of the radiation element (for example, a radiation conductor 21 in an embodiment) at a position spaced away outwardly from the outer edge portion, wherein the radiation element has an inner cut-out portion (for example, an inner cut-out portion 23 in the embodiment) so that the surface of the dielectric substrate to be exposed therethrough.

According to a second aspect of the present invention, the radiation element is a substantially quadrangular film having two pairs of two opposing corner portions, and the one pair of two corner portions is cut so as to form substantially linear perturbative portions.

According to a third aspect of the present invention, the radiation element is circular-shape having a predetermined width.

According to a fourth aspect of the present invention, an inner edge portion of the inner cut-out portion follows an outer edge portion of the radiation element at a position spaced away inwardly a predetermined widthwise distance from the outer edge portion of the radiation element.

According to a fifth aspect of the present invention, an external size of the on-board antenna with the inner cut-out portion is smaller than that of an on-board antenna without the inner cut-out portion.

According to a sixth aspect of the present invention, the radiation element may be a semiconductor.

According to the on-board antenna constructed as described above, by forming the inner cut-out portion in the interior of the radiation element, the resonant frequency can be decreased further while securing desired transmitting and receiving properties therefor when compared to a radiation element in which no such inner cut-out portion is formed therein, whereby in an attempt to secure a desired resonant frequency for the radiation element in which the inner cut-out portion is provided, the radiation element can be made smaller in size or the area of the radiation element on the surface of the dielectric substrate can be decreased when compared to the radiation element in which no cut-out portion is provided.

Namely, since the size of the surface of the radiation element on the surface of the dielectric substrate is set in accordance with the wavelength of a target radio wave, the size of the surface of the radiation element can be decreased in such a manner that an anticipated decrease in resonant frequency that would be caused by the provision of the cut-out portion can be compensated for.

In conjunction with this, the size of the surface of the grounding conductor can be decreased, and as a result, the on-board antenna can be made smaller in size.

DETAILED DESCRIPTION OF THE PREFERRED EMBODIMENTS

Referring to the accompanying drawings, an embodiment of an on-board antenna of the present invention will be described below.

Figure 1:
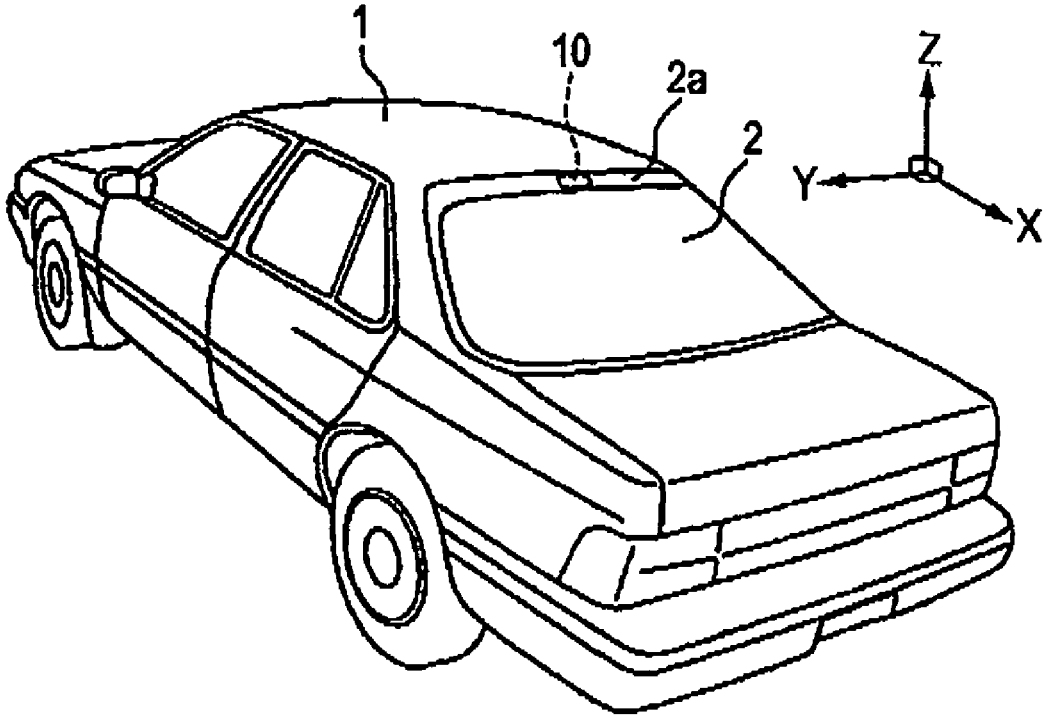
FIG. 1 is a perspective view of a vehicle on which an on-board antenna according to an embodiment of the present invention is installed.
Figure 2:
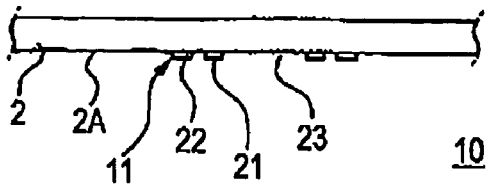
FIG. 2 is a cross-sectional view of the on-board antenna shown in FIG. 1.

An on-board antenna 10 according an embodiment of the present invention is, as shown in FIGS. 1 and 2, disposed on, for example, a passenger compartment-side inner surface 2A of a peripheral edge portion 2*a* of a rear window glass, for example, of window glasses of a vehicle 1.

Then, this on-board antenna 10 is may be, for example, a GPS (Global Position System) antenna used in receiving a positioning signal from a GPS communications network for measuring the position of a vehicle by making use of an artificial earth satellite or transmitting an emergency message by making use of positional information from GPS, for example, a DSRC (Dedicated Short Range Communications) antenna used in receiving data distributed from various types of information providing services or implementing a process of automatic toll collection through a narrow area radio communications DSRC between roadside radio equipment and on-board radio equipment, for example, an antenna for receiving data distributed from broadcasting and/or various types of information providing services which utilize an artificial earth satellite, or, for example, a mobile communications antenna used for mobile communications between an artificial earth satellite or appropriate base station and the vehicle.

Figure 3:
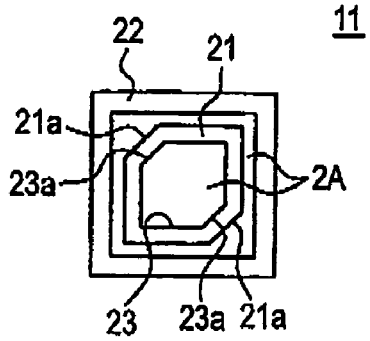
FIG. 3 is a plan view of the on-board antenna shown in FIG. 1.

The on-board antenna 10 includes, for example, a planar antenna 11 disposed on a passenger compartment-side inner surface 2A of a rear window glass 2 which functions as a dielectric substrate, and the planar antenna 11 includes, for example, as shown in FIG. 3, a radiation element 21 comprising a conductive film disposed on the passenger compartment-side inner surface 2A of the rear window glass 2 and a grounding conductor 22.

The radiation element 21 is formed such that, in a substantially quadrangular conductive film having two pairs of two opposing sides, for example, a pair of two corner portions of two pairs of two opposing corner portions which are formed by two adjacent sides which intersect each other substantially at right angles is cut so as to form substantially linear perturbative portions 21*a*, 21*a*, so that a circularly polarized wave mode is generated by these perturbative portions 21*a*, 21*a*.

Furthermore, an inner cut-out portion 23, which is made to be a through hole, is provided in the interior of the radiation element 21, so that the passenger compartment-side inner surface 2A of the rear window glass 2 is exposed through the inner cut-out portion 23, and the radiation element 21 is formed substantially into an annular shape which is completed when end portions of a belt-like conductor of a predetermined width, for example, are connected together.

Here, an inner edge portion of the inner cut-out portion 23 is formed so as to have a configuration which follows an outer edge portion of the radiation element 21 at a position spaced away inwardly a predetermined widthwise distance from the outer edge portion.

Due to this, substantially linear corner portions 23*a*, 23*a* which follow, respectively, a pair of substantially linear perturbative portions 21*a*, 21*a* formed on the outer edge portion of the radiation element 21 are formed at a pair of two corner portions of two pairs of two opposing corner portions on the inner edge portion of the inner cut-out portion 23.

Then, the radiation element 21 is connected to an appropriate feeding line (not shown) so that an appropriate high-frequency electric current is fed thereto.

The grounding conductor 22 is formed into a substantially quadrangular annular conductive film and is connected to an appropriate ground wire (not shown) so as to be grounded at all times. The grounding conductor 22 is disposed so as to surround the periphery of an outer edge portion of the radiation element 21 provided on the passenger compartment-side inner surface 2A of the rear window glass 2 at a position spaced away outwardly from the outer edge portion.

According to this construction, the passenger compartment-side inner surface 2A of the rear window glass 2 which is made to function as the dielectric substrate is exposed between the outer edge portion of the radiation element 21 and an inner edge portion of the grounding conductor 22, and the planar antenna 11 is made to function as an antenna when a so-called resonance circuit is formed between the radiation element 21 and the grounding conductor 22.

Here, by setting the antenna properties of the planar antenna, for example, the resonant frequency and frequency band of a radio wave to be transmitted and received to desired values, the permitivity of the rear window glass 2 made to function as the dielectric substrate, respective lengths of the two pairs of opposing sides of the radiation element 21 and the distance between the outer edge portion of the radiation element 21 and the inner edge portion of the grounding conductor 22 are set to appropriate values.

For example, in an attempt to secure a desired resonant frequency, the respective lengths of two pairs of two opposing sides of the radiation element 21 are set to lengths which are smaller by predetermined extents than lengths that are set in a state in which the inner cut-out portion 23 is not provided.

Namely, by providing the inner cut-out portion 23 in the interior of the radiation element 21, the resonant frequency can be decreased when compared to a case where no inner cut-out portion 23 is provided in a radiation element having the same external size as that of the radiation element 21.

Figure 4:
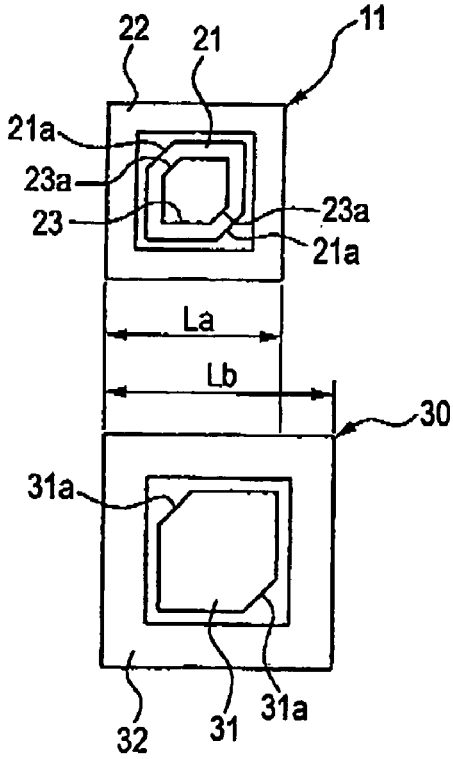
FIG. 4 is a plan views of the on-board antenna shown in FIG. 1 and a planar antenna in which no inner cut-out portion is provided.

According to this construction, as shown in FIG. 4, for example, an anticipated decrease in resonant frequency that would be caused by the provision of the inner cut-out portion 23 can be compensated for by setting the external size (for example, the respective lengths La of the two pairs of two opposing sides) of the radiation element 21 in which the inner cut-out portion 23 is provided smaller than an external size (for example, the respective lengths Lb of two pairs of two opposing sides) of a radiation element 31 of a planar antenna 30 which is set to secure a desired resonant frequency in a state in which no inner cut-out portion 23 is provided.

Note that, in FIG. 4, the planar antenna 30 in which no inner cut-out portion 23 is provided includes the radiation element 31 having perturbative portions 31*a*, 31*a* which are formed by cutting a pair of corner portions of a substantially rectangular conductive film and a grounding conductor 32 disposed in such a manner as to surround the periphery of an outer edge portion of the radiation element 31 at a position spaced away outwardly from the outer edge portion.

Figure 5A:
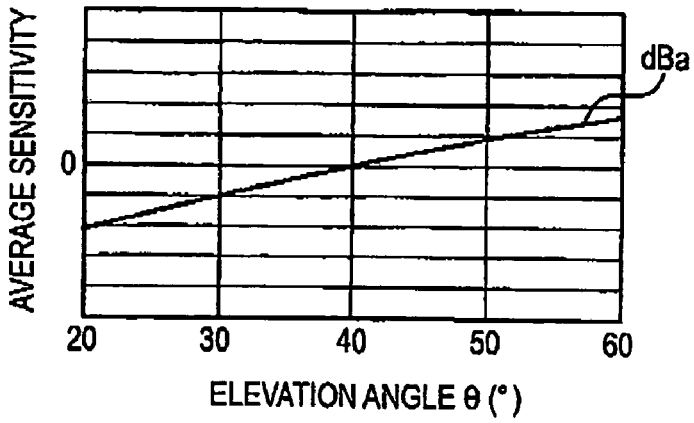
FIG. 5A is a graph illustrating one example of a change according to an elevation angle θ in average sensitivity of the on-board antenna shown in FIG. 1.
Figure 5B:
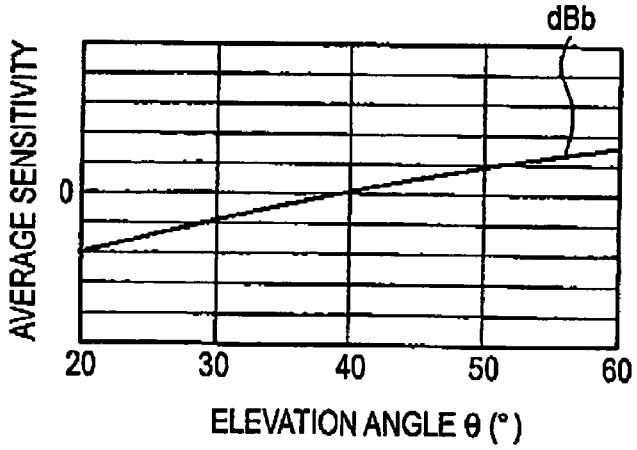
FIG. 5B is a graph illustrating one example of a change according to an elevation angle θ in average sensitivity of the planar antenna having no inner cut-out portion provided therein which is shown in FIG. 4.

For example, as shown in FIG. 5A, it is recognized that a change according to an elevation angle θ in average value (average sensitivity) dBa around a vertical axis (an axis Z shown in FIG. 1) of a sensitivity or gain relative to a radio wave at a desired resonant frequency of the on-board antenna 10 becomes substantially similar to the sensitivity Db of the planar antenna 30 having no inner cut-out portion 23 which is shown in FIG. 5B, for example.

Figure 6A:
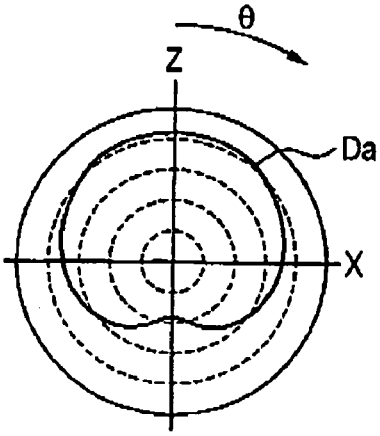
FIG. 6A is a graph illustrating one example of a change according to an elevation angle θ in sensitivity within a plane containing a vertical axis Z and a longitudinal axis X of a vehicle which is associated with the on-board antenna shown in FIG. 1.
Figure 6B:
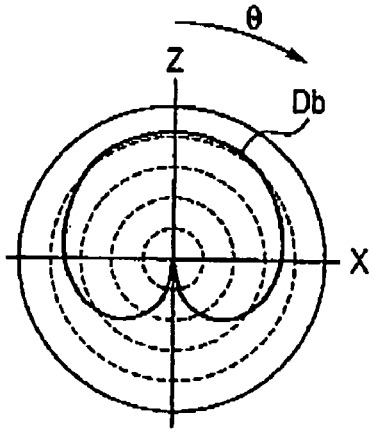
FIG. 6B is a graph illustrating one example of a change according to an elevation angle θ in sensitivity within the plane containing the vertical axis Z and the longitudinal axis X of the vehicle which is associated with the planar antenna having no inner cut-out portion provided therein which is shown in FIG. 4.

In addition, for example, it is recognized as shown in FIG. 6A that with a change according to the elevation angle θ in sensitivity Da relative to a radio wave at a desired resonant frequency of the on-board antenna 10 within a plane containing the vertical axis Z (the axis Z shown in FIG. 1) and a longitudinal axis X (an axis X shown in FIG. 1) of the vehicle, a desired directional property can be secured, as with the sensitivity Db of the planar antenna 30 having no inner cut-out portion 23 which is shown in FIG. 6B, for example.

As has been described heretofore, according to the on-board antenna 10 according to the embodiment of the present invention, by providing the inner cut-out portion 23 in the interior of the radiation element 21, the resonant frequency can be decreased further while securing desired properties of sensitivity when compared to the radiation element 30 in which the inner cut-out portion 23 is not provided, whereby, in an attempt to secure a desired resonant frequency for the radiation element 21 in which the inner cut-out portion 23 is provided, the external size of the radiation element 21 can be made smaller than that of the radiation element 30 in which the inner cut-out portion 23 is not provided. In conjunction with this, the external size of the grounding conductor 22 can be decreased, and as a result, the on-board antenna 10 can be made smaller in size.

Note that while, in the embodiment of the present invention, the planar antenna 11 is made to include the radiation conductor 21 which is formed of the conductive film and the grounding conductor, the present invention is not limited thereto. For example, a radiation element formed of a semiconductor may be provided in place of the radiation conductor 21.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

As has been described heretofore, according to the on-board antenna as set forth in the first aspect of the present invention, by providing the inner cut-out portion in the interior of the radiation element, the resonant frequency can be decreased further while securing desired properties of sensitivity when compared to the radiation element in which the inner cut-out portion is not provided, whereby, in an attempt to secure a desired resonant frequency for the radiation element in which the inner cut-out portion is provided, the size of the radiation element can be made smaller than that of the radiation element in which the inner cut-out portion is not provided. Namely, the areas of the radiation element and the grounding conductor which are placed on the dielectric substrate can be decreased.

What is claimed is:

1. An on-board antenna comprising:

a radiation element provided on a dielectric substrate;

a grounding conductor surrounding a periphery of an outer edge portion of the radiation element at a position spaced away outwardly from the outer edge portion; and an inner cut-out portion completely surrounded by an inner periphery of the radiation element, wherein an entire inner area defined by an outer boundary of the inner cut-out portion exposes the dielectric substrate therethrough, and wherein the radiation element and the grounding conductor are provided on the same surface of the dielectric substrate.

2. An on-board antenna as set forth in claim 1, wherein the radiation element is a substantially quadrangular film having two pairs of opposing corner portions, and wherein one pair of the opposing corner portions is cut to form substantially linear perturbative portions.

3. An on-board antenna as set forth in claim 1, wherein the radiation element is circular-shape having a predetermined width.

4. An on-board antenna as set forth in claim 1, wherein an inner edge portion of the inner cut-out portion follows an outer edge portion of the radiation element at a position spaced away inwardly a predetermined widthwise distance from the outer edge portion of the radiation element.

5. An on-board antenna as set forth in claim 1, wherein an external size of the on-board antenna with the inner cut-out portion is smaller than that of an on-board antenna without the inner cut-out portion.

6. An on-board antenna as set forth in claim 1, wherein the radiation element is a semiconductor.

7. An on-board antenna comprising:

a radiation element provided on a dielectric substrate; and a grounding conductor surrounding a periphery of an outer edge portion of the radiation element at a position spaced away outwardly from the outer edge portion;

wherein the radiation element has an inner cut-out portion exposing the dielectric substrate therethrough, wherein the radiation element and the grounding conductor are provided on the same surface of the dielectric substrate, wherein the radiation element is a substantially quadrangular film having two pairs of opposing corner portions, and wherein one pair of the opposing corner portions is cut to form substantially linear perturbative portions.

8. An on-board antenna as set forth in claim 7, wherein the radiation element is circular-shape having a predetermined width.

9. An on-board antenna as set forth in claim 7, wherein an inner edge portion of the inner cut-out portion follows an outer edge portion of the radiation element at a position spaced away inwardly a predetermined widthwise distance from the outer edge portion of the radiation element.

10. An on-board antenna as set forth in claim 7, wherein an external size of the on-board antenna with the inner cut-out portion is smaller than that of an on-board antenna without the inner cut-out portion.

11. An on-board antenna as set forth in claim 7, wherein the radiation element is a semiconductor.

* * * * *